United States Patent [19]

Fusselman et al.

[11] 4,416,501

[45] Nov. 22, 1983

[54] TERMINAL FOR ESTABLISHING ELECTRICAL CONTACT WITH A SHIELDED CABLE

[75] Inventors: David F. Fusselman, Elizabethtown; Timothy A. Lemke, Carlisle, both of Pa.

[73] Assignee: E. I. Du Pont de Nemours & Co., Wilmington, Del.

[21] Appl. No.: 324,132

[22] Filed: Nov. 23, 1981

[51] Int. Cl.[3] ..... H01R 11/20

[52] U.S. Cl. ..... 339/97 R; 174/75 C; 339/177 R

[58] Field of Search ..... 339/97 R, 97 P, 97 C, 339/177 R, 177 E; 174/75 C, 78, 89

[56] References Cited

U.S. PATENT DOCUMENTS

| | | | |
|---|---|---|---|
| 3,406,373 | 10/1968 | Forney, Jr. | 339/97 S |
| 3,517,375 | 6/1970 | Mancini | 339/177 R |
| 3,530,423 | 9/1970 | Davis | 339/89 R |
| 3,683,320 | 8/1972 | Woods et al. | 339/177 E |
| 3,740,453 | 6/1973 | Callaghan et al. | 339/177 R |
| 3,744,007 | 7/1973 | Horak | 339/97 R |
| 4,261,632 | 4/1981 | Narozny | 339/97 C |

*Primary Examiner*—Joseph H. McGlynn
*Assistant Examiner*—Paula Austin

[57] ABSTRACT

A terminal for establishing electrical contact with the conductive shield of a cable having an aluminized Mylar® layer surrounded by an outer braid and then a layer of insulation forming a jacket. A ferrule is inserted between the outer braid and the Mylar® and is locked in place by an insulator displacement device which penetrates the insulation jacket to establish electrical contact with the shield.

7 Claims, 5 Drawing Figures

TERMINAL FOR ESTABLISHING ELECTRICAL CONTACT WITH A SHIELDED CABLE

BACKGROUND OF THE INVENTION

This invention relates to an electrical connector for a shielded cable, and more particularly to a connector for electrically and mechanically terminating such a cable.

Numerous connectors have been disclosed by the prior art for electrically and mechanically terminating shielded cable. For example, U.S. Pat. No. 3,406,373 discloses an inner-sleeve member having a plurality of barbed arms folded back over the sleeve. The barbs are adapted to penetrate a Mylar® coating which has been exposed to stripping away the outer insulation. U.S. Pat. No. 3,744,007 discloses a serrated crimping washer penetrating the outer insulation sheath of a coaxial cable in order to provide electrical connection with a braided outer conductor. U.S. Pat. No. 4,261,632 discloses a sleeve member with a tongue containing insulation piercing tines. The tongue penetrates the outer jacket of insulation and provides electrical connection with outer conductor of a coaxial cable. These types of connections often result in imperfect electrical connection because there is insufficient mechanical support behind the point of contact of the penetrating device.

SUMMARY OF THE INVENTION

In accordance with the present invention there is provided a terminal for establishing an electrical connection between a metallic shroud surrounding an interface bus connector and an insulated cable terminated on the connector having a flexible conductive shield beneath the insulation. In a particular embodiment, the cable has an aluminized Mylar® layer surrounded by the conductive shield. A ferrule which is preferably longitudinally split is inserted between the outer shield and the Mylar® and is locked in place by an insulation displacement device which penetrates the insulation jacket to establish an electrical connection with the shield. The shroud is retained by an outwardly projecting portion of the insulation penetrating device.

DETAILED DESCRIPTION OF THE PREFERRED EMBODIMENT

Figure 1:
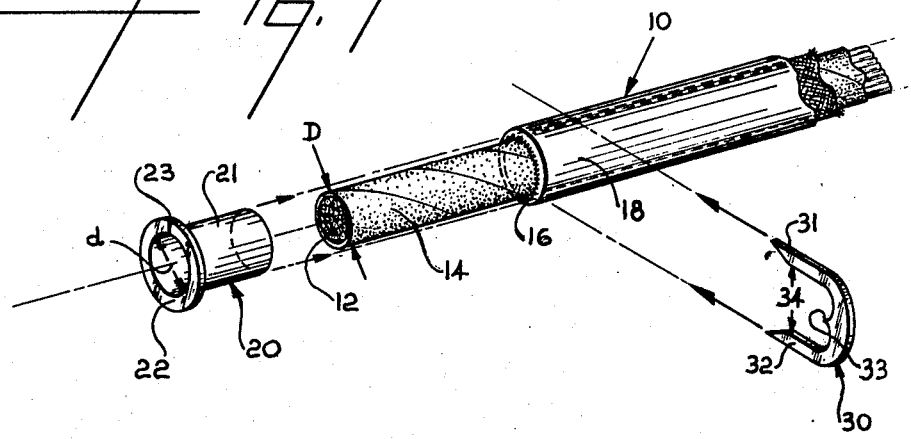
FIG. 1 is an exploded perspective view showing a segment of cable stripped for use with the connector assembly of the invention.
Figure 2:
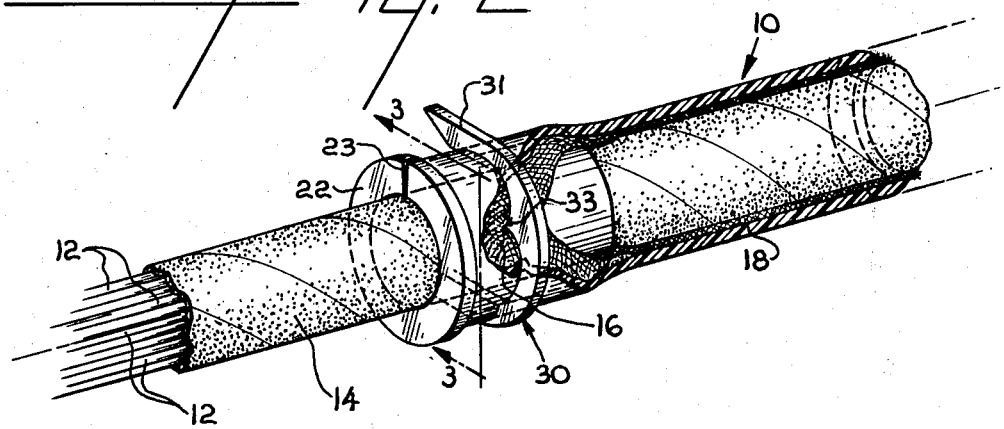
FIG. 2 is a perspective view of the cable and connector of the invention.
Figure 3:
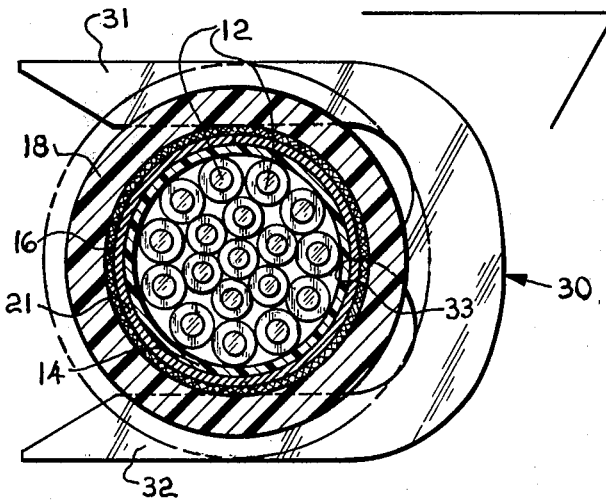
FIG. 3 is a cross-sectional view slightly enlarged taken along line 3—3 of FIG. 2.

Referring now to FIGS. 1–3, a multiconductor shielded cable 10 includes a plurality of conductors 12 covered in turn by an aluminized Mylar® layer 14, a flexible conductive shield 16 and an outer layer of insulation 18. The inner conductors 12 may be either stranded wire or single filament whereas the flexible conductive shield 16 is generally in the form of a braided screen sheath comprised of wire filaments braided together and concentrically arranged around the inner conductors 12 and aluminized Mylar® film 14. Where the inner conductors are to be terminated, the cable 10 is prepared by removing the outer insulation 18 and the flexible conduction shield 16 from a portion of the cable to leave an exposed end of the cable covered by the aluminized Mylar® film 14.

The terminal connector for the exposed end of the cable is comprised of a ferrule 20 and a "U"-shaped insulation penetration member 30. The ferrule is comprised of a metallic sleeve having an outwardly projecting collar 21 attached to one end. The ferrule has an inner diameter "d" that is slightly larger than the diameter D of the exposed end of the cable 10 and is split longitudinally at one location 23. The "U"-shaped penetration device 30 includes a trio of insulation piercing tines 31, 32 and 33. Tines 31, 32 are spaced to define a slot 34 between them, are substantially flat and are of a substantial width as compared to the thickness so that the tines 31, 32 are not easily movable apart or toward one another to change the width of the slot 34. Tine 33 is sharply pointed and has sufficient length to pierce insulation layer 18 and contact flexible conductive shield 16.

The terminal connector for the exposed end of cable 10 is installed by sliding the ferrule onto the exposed end of the cable and forcing it between the aluminized Mylar® layer 14 and the shield 16. Next the "U"-shaped insulation penetration device 30 is pressed on cable 10 a specified distance from collar 22 of ferrule 20; the insulation piercing tines 31, 32, 33 slice or pierce insulation layer 18 to allow the tines to capture the shield 16 in compression and make an electrical contact between the shield, the ferrule and the insulation penetration device. When the "U"-shaped device 30 is forced over ferrule 20, the sleeve 21 of the ferrule which is split is compressed; it provides an additional means for storing energy in the system resulting in added reliability of contact. The sleeve 21 presents an outward force and the "U"-shaped penetration device presents an inward force which results in added reliability and contact integrity.

Figure 4:
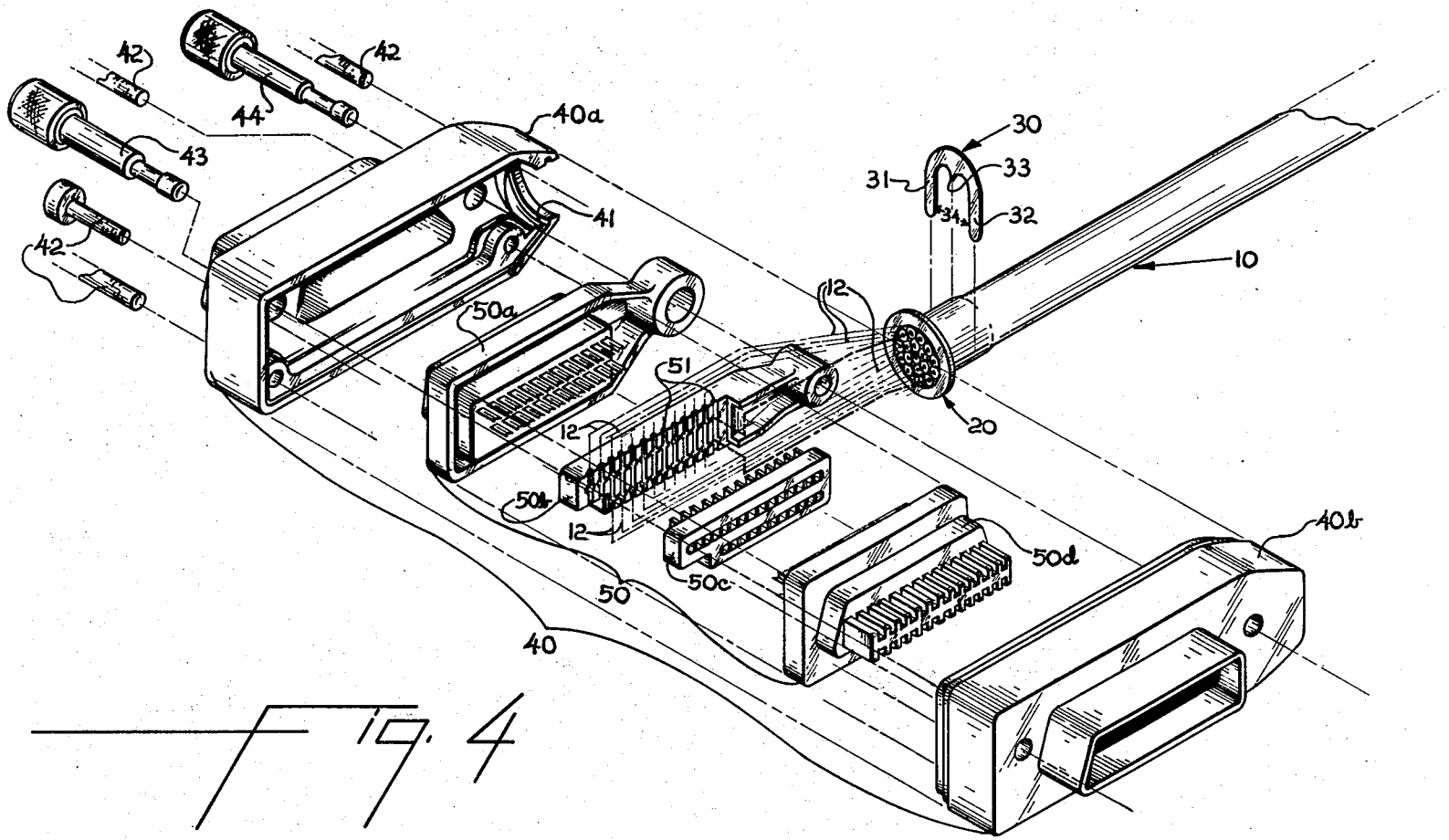
FIG. 4 is an exploded perspective view showing the relationship of the cable, the cable terminal, the bus connector and the metallic shroud which surrounds the bus connector.
Figure 5:
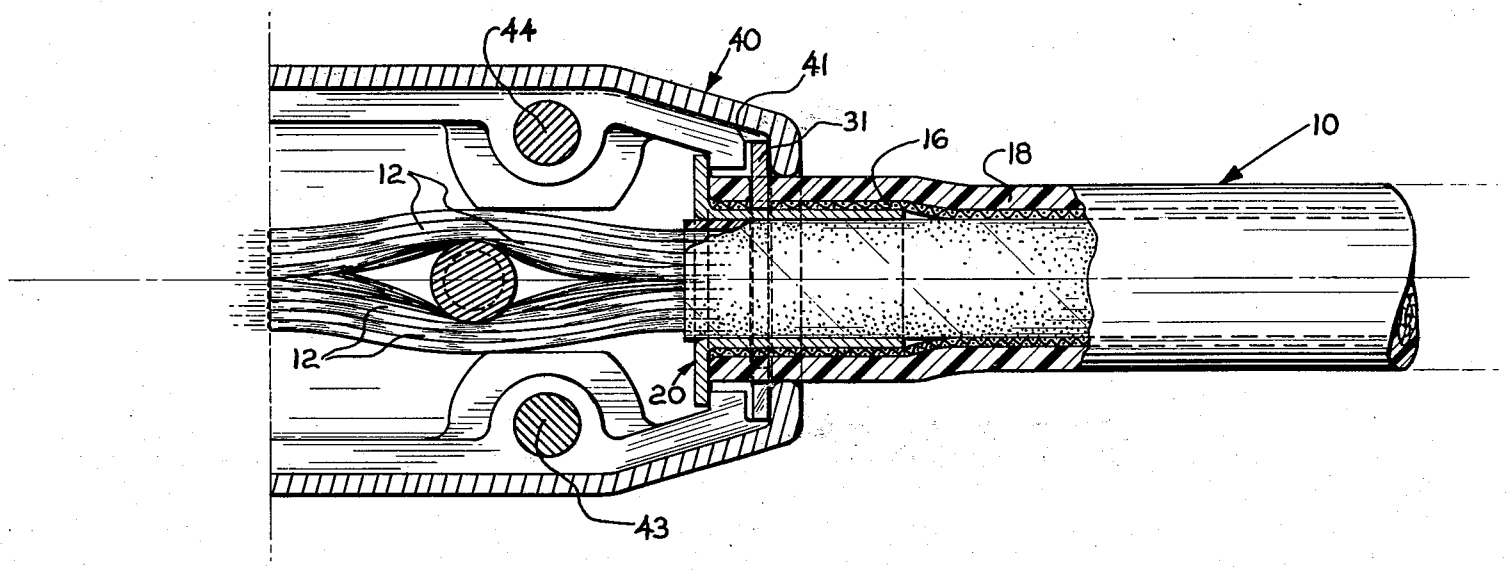
FIG. 5 is a side elevation view partially in cross-section showing the bus connector shroud being retained by a portion of the insulation penetrating device.

The cable thus terminated is used with a connector assembly as best shown in FIGS. 4 and 5. The assembly consists generally of a wiring block 50 and an RF shroud generally designated 40 used to shield the connector assembly from extraneous radio frequency transmissions or to prevent such emissions from the assembly.

The connector 50 is assembled by first inserting the wires 12 from the cable 10 into the appropriate holes 51 of the wiring block **50*b*. These may be pushed through the block and trimmed to length. The cover 50*c* is then pressed in place. The conductors are assembled on precise centers at this stage and are ready for mass termination. The plug 50*a* and receptacle 50*d* which have tined type terminations to make contact with the wires 12 are then pressed onto their respective sides of the wiring block 50*b*, 50*c***.

The RF shroud 40 is assembled around the wiring block 50, the collar or ferrule 20 and the insulation penetrating device 30. The two halves **40*a* and 40*b* of the shroud telescope into one another and device 30 fits into recess 41 of shroud 40 contacting the shroud. The shroud is then fastened together by means of bolts 42, 43, 44**.

We claim:

1. In an electrical connector surrounded by a metallic shroud into which an insulated cable having a flexible conductive shield beneath an outer layer of insulation enters through an opening in such shroud for termination on said connector, a terminal for establishing an electrical connection between the shield and the shroud comprising a ferrule positioned on said cable beneath and supporting a portion of said flexible conductive shield, and a "U"-shaped insulation penetrating device penetrating the outer layer of insulation and capturing said ferrule and said shield and establishing contact with the flexible conductive shield with an inward compressive force while presenting an outwardly projecting portion, said opening in said shroud defining a spaced recess into which the outwardly projecting portion of the insulating penetrating device fits and makes contact with the shroud.

2. The terminal as defined in claim 1, said ferrule being longitudinally split at one location and supporting the shield with an outward force.

3. The terminal as defined in claims 1 or 2, said ferrule having an outwardly projecting collar spaced from the outwardly projecting portion of the "U"-shaped insulation penetration device.

4. The terminal as defined in claim 1 said ferrule having a diameter "d" slightly larger than the diameter "D" of the exposed end of the cable.

5. In an insulated cable having a flexible conductive shield beneath an outer layer of insulation, a terminal for establishing an electrical connection with the shield, said electrical connection comprising: a ferrule positioned on said cable beneath said conductive shield, said ferrule supporting a portion of said shield; and a "U"-shaped insulation penetration device having an opening sized to capture said ferrule and said shield and contact said shield with an inward compressive force, said "U"-shaped device having a portion projecting outwardly from said outer layer of insulation.

6. The terminal as defined in claim 5 said ferrule being longitudinally split at one location and supporting the shield with an outward force.

7. The terminal as defined in claims 5 or 6, said ferrule having an outwardly projecting collar at one end and the diameter "d" of the ferrule is slightly larger than the diameter "D" of the exposed end of the cable.

* * * * *